US005323569A

United States Patent [19]

Walz

[11] Patent Number: 5,323,569

[45] Date of Patent: Jun. 28, 1994

[54] ITEM OF FURNITURE, PARTICULARLY A CABINET, WHICH IS CLOSABLE BY A ROTATING/SLIDING DOOR

[75] Inventor: Rüdiger Walz, Pfaffeneckerstrasse, Fed. Rep. of Germany

[73] Assignee: Hafele GmbH & Co., Nagold, Fed. Rep. of Germany

[21] Appl. No.: 926,486

[22] Filed: Aug. 7, 1992

[30] Foreign Application Priority Data

Aug. 9, 1991 [DE] Fed. Rep. of Germany ..... 9109850

[51] Int. Cl.[5] ..... E05D 15/58

[52] U.S. Cl. ..... 49/258; 74/89.1; 74/422; 312/322

[58] Field of Search ..... 49/258, 259, 254, 250; 74/891, 422; 312/322, 323

[56] References Cited

U.S. PATENT DOCUMENTS

| | | | |
|---|---|---|---|
| 1,088,001 | 2/1914 | Whitcomb | 74/422 X |
| 2,058,431 | 10/1936 | Eschenbacher | 74/422 |
| 4,375,907 | 3/1983 | Vander Kooi et al. | 312/323 X |
| 4,600,254 | 7/1986 | Whalen | 49/258 X |

FOREIGN PATENT DOCUMENTS

| | | | |
|---|---|---|---|
| 534177 | 6/1927 | Fed. Rep. of Germany | 49/258 |

*Primary Examiner*—Philip C. Kannan
*Attorney, Agent, or Firm*—Akoo-Toren

[57] ABSTRACT

An item of furniture is described wherein, in order to economize on space, rotating and/or sliding doors are used for closing items of furniture, particularly cabinets. The cabinets comprise a shaft opposite the opening side of the body, which shaft is supported vertically relative to the sliding direction and is provided with at least two toothed pinions which are arranged at a distance from one another and engage in corresponding toothed racks which are securely connected with the door. These toothed racks are supported at the shaft so as to be displaceable transversely relative to its longitudinal axis. To obtain an especially advantageous guidance for the door, the rails, provided with the rows of teeth, are constructed, at least at their opposite longitudinal edges, as guide rails for rollers of running carriages which are fixedly connected with the shaft.

9 Claims, 3 Drawing Sheets

ITEM OF FURNITURE, PARTICULARLY A CABINET, WHICH IS CLOSABLE BY A ROTATING/SLIDING DOOR

FIELD OF THE INVENTION

The present invention pertains to an item of furniture, particularly a cabinet, which is closable by a rotating and/or a sliding door.

BACKGROUND OF THE INVENTION

Furniture and/or cabinets which can be closed by a rotating and/or a sliding door and which comprise a shaft which is supported opposite the opening side of the body so as to be rotatable vertically relative to the sliding direction are already known from the prior art. The shaft is provided with at least two toothed pinions which are arranged at a distance from one another and engage in corresponding toothed racks which are connected in a fixed manner with the door. Moreover, these toothed racks are supported at the shaft so as to be displaceable transversely relative to the longitudinal axis of the shaft. In cabinets which are provided with such fittings, the door can be opened in a rotating and/or a sliding movement and can be placed inside or outside the side wall of the cabinet in their open position so that the space requirement is very small. However, in known constructions of this type, the guidance for the door is unsatisfactory, particularly in heavy cabinets. The present invention serves to overcome the disadvantages and short falls of the prior art.

SUMMARY OF THE INVENTION

The item of furniture which is the subject of the present invention overcomes the disadvantages and shortfalls of the prior art in that rails, provided with rows of teeth, are constructed, at least at their opposite longitudinal edges, as guide rails for rollers of running carriages which are fixedly connected with the shaft.

The use of running carriages, provided with two or more rollers, results in an unobjectionable and relatively wide guidance for the door so that there exists no risk of sinking on one side, particularly in heavy doors.

The running carriages preferably comprise a roller carrier connected with the shaft and two or more rollers. Holding brackets, at which the roller carriers are fastened so as to be displaceable in the axial direction, are advisably provided at the shaft. In this manner, it is possible to compensate for inaccuracies when installing the fitting and, above all, to achieve a connection of the parts which is free of play. The holding brackets, which have elongated holes, and the roller carriers, are provided with ribs which engage with one another for an adequately secure connection between the holding bracket and the roller carriers in spite of the vertical adjustability.

Since backward movements can take place during displacement when using conventional toothed racks, the rows of teeth and the toothed pinions, engaging with the latter, are divided transversely according to a further feature of the present invention so that the teeth of the partial rows and the partial pinions are slightly offset relative to one another. A continuous engagement of the teeth is accordingly achieved so that play is reduced.

In order to simplify the production and facilitate assembly, the rails are advisably constructed in two parts. A part which is connectable with the door is constructed as a section rail while the other part is constructed as a toothed rack. The toothed rack can advisably be inserted into the section rail and be screwed together with the latter. The section rails comprise a running surface for the rollers and a guide edge so as to ensure that the door is held securely at the running carriage. The rails are constructed so as to be longitudinally symmetrical so that they can be used for attachment at the top and bottom and in doors which open to the left and to the right. A third rail, which is grasped at both sides by running carriages, can be arranged between two rails.

Accordingly, it is an object of the present invention to provide an item of furniture which is closable by a rotating and/or a sliding door and which provides for satisfactory guidance for the door of said item of furniture.

It is another object of the present invention to provide for an item of furniture which is closable by a rotating and/or a sliding door which provides for unobjectionable and relatively wide guidance for a door utilized therewith and to prevent the sinking of same.

It is another object of the present invention to provide for an item of furniture which is closable by a rotating and/or a sliding door which provides for a simplified production and facilitates the assembly thereof.

It is another object of the present invention to provide for an item of furniture which is closable by a rotating and/or a sliding door which provides for a structure having reduced play therein.

Other objects and advantages of the present invention will be made apparent to those skilled in the art upon a review of the Description of the Preferred Embodiment taken in conjunction with the Drawings which follow.

DESCRIPTION OF THE PREFERRED EMBODIMENT

Figure 1:
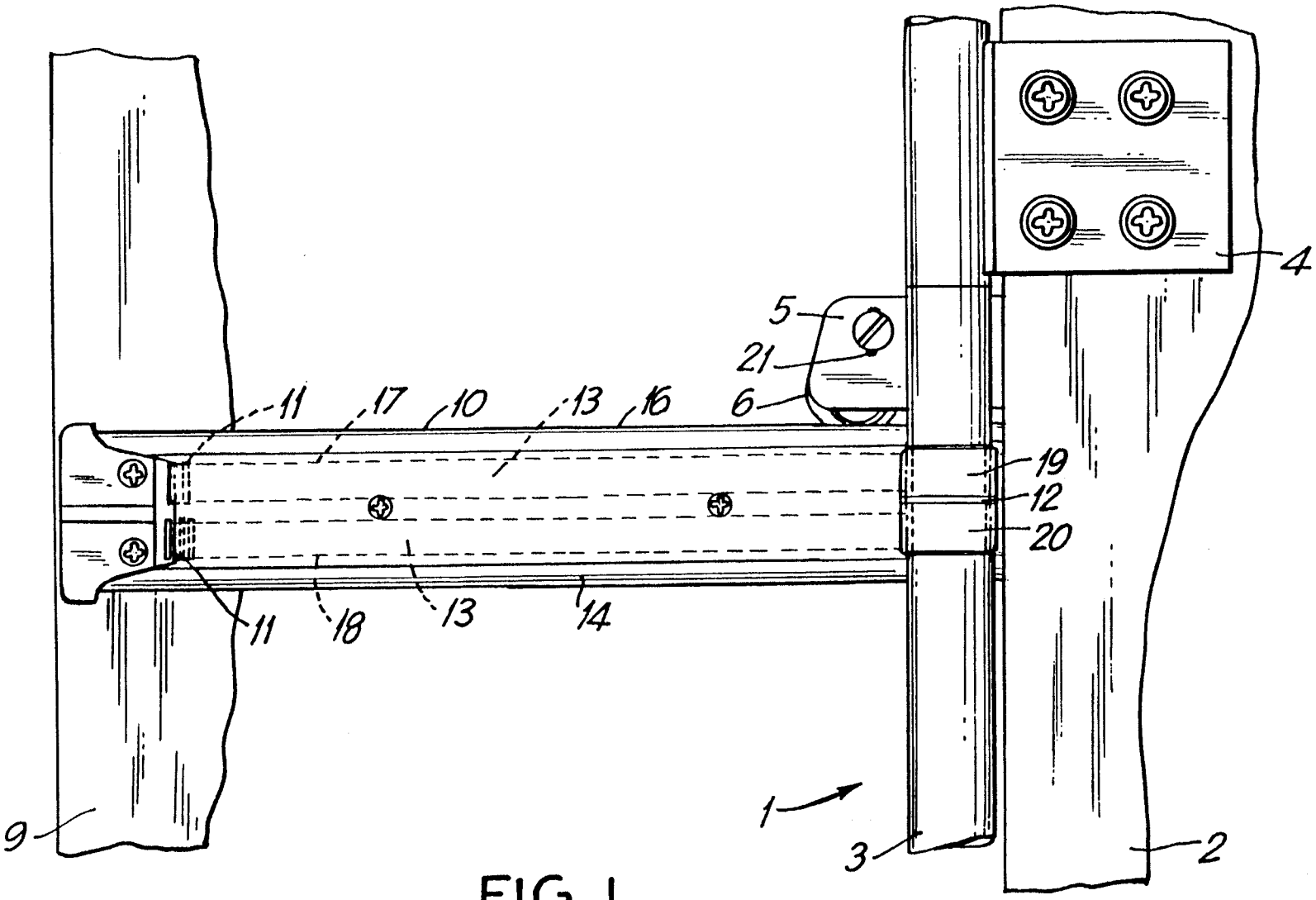
FIG. 1 illustrates a partially broken away view of a cabinet of the present invention having an open door which is partly slid back.
Figure 2:
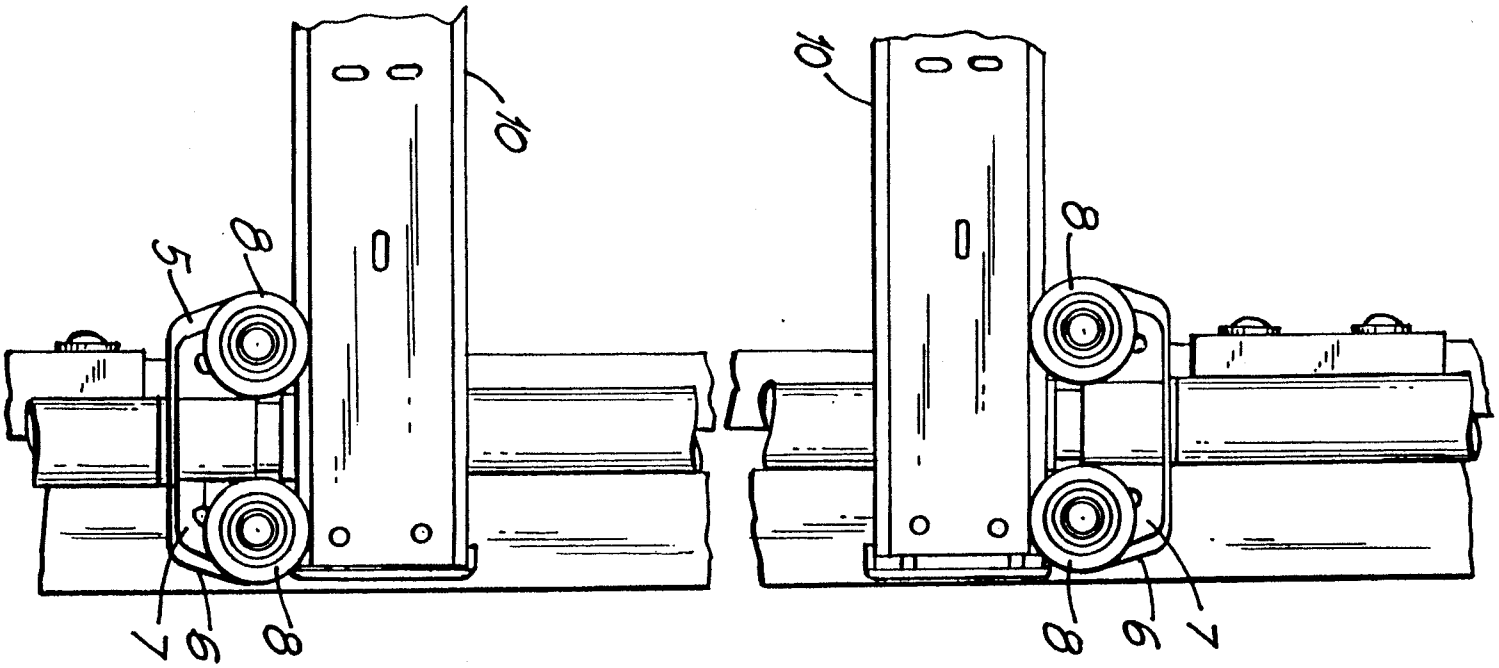
FIG. 2 illustrates a partially broken away front view of a rotating and/or sliding door fitting having a transparent door.

FIG. 1 illustrates the cabinet of the present invention, which is denoted generally by the reference numeral 1, in a partially broken away view, and having an open door which is partly slid back. FIG. 2 illustrates a partially broken away front view of a rotating and/or sliding door fitting which has a transparent door.

Referring to FIG. 1, a shaft 3 is rotatably supported at a body 2 of the cabinet 1 by means of a plurality of fitting parts 4. Holding brackets 5, which serve to fasten running carriages 6, are welded on the shaft 3 at a distance from one another. Referring to FIG. 2, these running carriages 6 comprise a roller carrier 7, which is screwed together with the holding bracket 5, and two rollers 8 in each instance. Referring once again to FIG. 1, two rails 10, which are provided with rows of teeth 11 on their surfaces, and which face the shaft 3, are fastened at the door 9 at a distance from one another corresponding to the running carriage 6. A toothed pinion 12, which engages in the rows of teeth 11 is fastened at the height of the latter.

Figure 3:
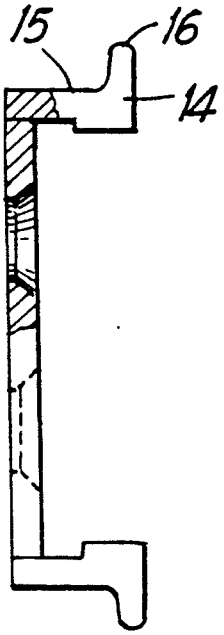
FIG. 3 illustrates a side view of a section rail partly in section.
Figure 4:
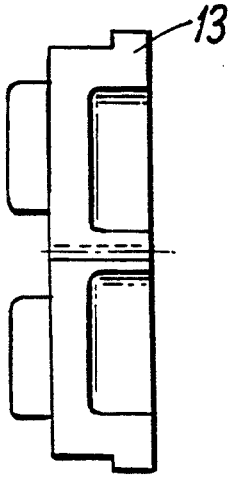
FIG. 4 illustrates a side view of a toothed rack.

The rails 10 are constructed in two parts. One rail part is constructed as a toothed rack 13 while the other is constructed as a section rail 14. FIG. 3 illustrates a side view of a section rail, partly in section. FIG. 4 illustrates a side view of a toothed rack. As can be seen from the cross sections in FIGS. 3 and 4, the toothed rack 13 can be inserted into the section rail 14 and then connected with it, for example, by screws. Referring to FIG. 3, the section rails 14 have running surfaces 15 for the rollers 8 of the running carriages 6 (see FIG. 2), and are provided with a guide edge 16 on their side which faces away from the door 9. The rails are constructed so as to be longitudinally symmetrical so that they can be used at the bottom and at the top and on doors opening to the right and to the left. The section rail 14 comprises running surfaces 15 and guide edges 16 at the two longitudinal edges.

As can be seen from FIG. 1, the rows of teeth 11 are divided transversely into two partial rows 17 and 18 teeth 11, one above the other, as is the pinion 12 formed of two partial pinions 19 and 20, the partial rows 17 and 18 of teeth 11 and the two partial pinions 19 and 20 have a slight offsetting of the teeth 11 relative to one another so as to ensure a running which is as quiet as possible.

Figure 5:
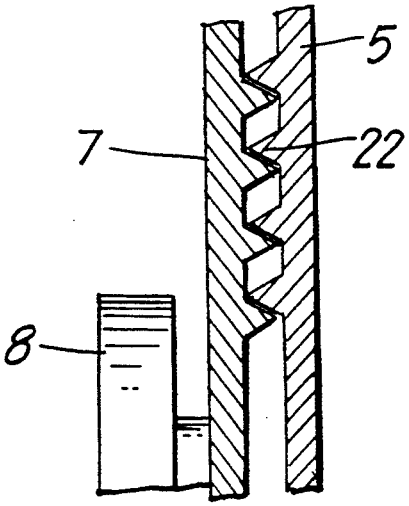
FIG. 5 illustrates a cross-sectional side view of a holding bracket and a roller carrier provided with ribs.

As can be seen in FIG. 1, the holding brackets 5 are provided with elongated holes 21 so that the roller carriers 7 can be displaced slightly in the longitudinal direction of the shaft 3. Accordingly, it is possible to compensate for inaccuracies, on the one hand. On the other hand, the play between the rollers 8 (see FIG. 2) and the running surfaces 15 (see FIG. 3) of the section rail 14 can be accurately adjusted. Referring to FIG. 5, the surfaces of the parts which contact one another are provided with transverse ribs 22 in order to ensure the vertical adjustment of the holding brackets 5 and the roller carriers 7 relative to one another.

Referring once again to FIG. 1, the door 9, which is supported so as to be longitudinally displaceable at the shaft 3 by means of the rails 10, can be displaced transversely relative to the shaft 3, as well as rotated with it, so that the door 9, as shown in FIG. 1, can be slid behind the side wall of the body 2. The engagement of the toothed partial pinions 19, 20 in the partial rows 17, 18 of teeth 11 ensures that the door 9 cannot tilt during the opening and closing movement. In this manner, a constant synchronous running of the upper and lower rails is achieved.

While a preferred embodiment of the apparatus of the present invention has been described herein, such description is meant to be merely illustrative of the present invention and is not meant to be a limitation thereof. Therefore, the present invention may encompass any and all variations, modifications and/or alternate embodiments, the scope of which is limited only by the claims which follow.

I claim:

1. An item of furniture comprising:

a body having an opening side;

a sliding door for closing the opening side of the body;

a rotatable shaft supported at the opening side of the body and extending perpendicular to a sliding direction of the door;

at least two tooth pinion members supported on the shaft and spaced from each other;

rail means fixedly connected with the door and supported on the shaft for displacement transversely to a longitudinal axis of the shaft, wherein the rail means includes at least two rows of teeth engageable with the at least two pinion members, and two opposite longitudinal guide edges; and two running carriages secured to the shaft on opposite sides of the rail means and each having roller means engaging a respective longitudinal guide edge to provide for unhindered sliding displacement of the door.

2. The item of furniture of claim 1, wherein each running carriage comprises a roller carrier connected with the shaft, and wherein the roller means comprises a plurality of rollers supported on the roller carrier.

3. The item of furniture of claim 2, further comprising two holding brackets for securing the two carriages to the shaft and displaceable in an axial direction of the shaft.

4. The item of furniture of claim 3, wherein respective contact surfaces of the holding brackets and the carriages are provided with ribs which engage each other.

5. The item of furniture of claim 1, wherein said two pinion members are offset relative to respective rows of teeth.

6. The item of furniture of claim 1, wherein the rail means comprises two rails formed each of a section rail secured to the door and a tooth rack defining a respective row of teeth and extending parallel to the section rail.

7. The item of furniture of claim 6, wherein the tooth rack is inserted into the section rail.

8. The item of furniture of claim 6, wherein the section rail has a running surface defining said guide edge.

9. The item of furniture of claim 6, wherein said rails are longitudinally symmetrical.

* * * * *